United States Patent [19]

Sato

[11] Patent Number: 4,616,116

[45] Date of Patent: Oct. 7, 1986

[54] SWITCH

[75] Inventor: Akira Sato, Yokohama, Japan

[73] Assignee: Alps Electric Co., Ltd., Japan

[21] Appl. No.: 709,448

[22] Filed: Mar. 8, 1985

[30] Foreign Application Priority Data

Mar. 8, 1984 [JP] Japan ..... 59-33462[U]

[51] Int. Cl.[4] ..... H01H 1/60

[52] U.S. Cl. ..... 200/242; 200/153 J; 200/159 R

[58] Field of Search ..... 200/242, 253, 16 R, 200/16 B, 16 C, 241, 245, 257, 260, 153 J, 293, 340, 159 R

[56] References Cited

U.S. PATENT DOCUMENTS 3,539,749 11/1970 MacPeat ..... 200/159 R
3,542,988 11/1970 Baldasare ..... 200/153 J
3,624,332 11/1971 Benschoten et al. ..... 200/241
3,914,570 10/1975 Lockard ..... 200/153 J
4,501,940 2/1985 Suzuki ..... 200/242

FOREIGN PATENT DOCUMENTS 1139185 11/1956 Fed. Rep. of Germany ..... 200/241
1925218 11/1970 Fed. Rep. of Germany ..... 200/242
2732723 2/1979 Fed. Rep. of Germany ..... 200/245

*Primary Examiner*—Stephen Marcus
*Assistant Examiner*—Linda J. Sholl
*Attorney, Agent, or Firm*—Guy W. Shoup

[57] ABSTRACT

A switch including a self-cleaning mechanism comprises a slider movable in directions toward and away from fixed contacts, a moving contact, having flanges, contactable with the fixed contacts, and a spring for pushing the moving contact toward the fixed contacts. The slider has rest portions upon which the flanges abut under the state where the moving contact is in the inclined pose with respect to the slider-moving direction.

4 Claims, 8 Drawing Figures

SWITCH

FIELD OF THE INVENTION

The present invention relates to an operation switch equipped with a self-cleaning mechanism for contacts.

BACKGROUND OF THE INVENTION

In the operation switch, if dust and the like adheres to contacts fixed inside a switch case, inferior contacting occurs between the contacts and a moving contact connectable with the former. Therefore, some of recently marketed operation switches have a self-cleaning mechanism to sweep off dust and the like adhered to the contacts.

FIG. 1 illustrates an example of the switch provided with such a self-cleaning mechanism.

In this switch, as an operation member 1 is pushed in the arrow direction, it advances in opposition to the repulsion force of a spring 2. Upon an inner portion of this operation member 1 a slide member 3 is abutting, thus, this slide member 3 also advances at the same time. As a result, a lever 4 abutting upon the slide member 3 pivots about a lower fulcrum 0 provided inside a wafer 5. As the lever 4 pivots, a conductor plate 6 whose upper end is engaged to a bracket 4*a* provided in rear of the lever 4 is pushed downward in opposition to a tension spring 7. Due to the downward movement of this conductor plate 6 contacts 6*a* and 8*a* slide mutually thereby to sweep off dust and the like on respective contacts 6*a* and 8*a* (the self-cleaning action). In addition, as shown in FIG. 2 which is a partial enlarged view of FIG. 1, as the operation member 1 is pushed further in the arrow direction, the conductor plate 6 being pushed by the bracket 4*a* of the lever 4 snaps in the arrow direction owing to the flip-flop action of the tension spring 7, the contact 6*a* at the tip comes in abuttment with the contact 8*a* fixed on the other connection terminal 8 (in the alternate long and short dash line position). Then, as the operation member 1 is pushed further, the contact 6*a* of the conductor plate 6 slides on this contact 8*a*, whereby the contacts 6*a* and 8*a* are self-cleaned (in the alternate long and two short dashes line state). Because the conductor plate 6 is conducted to a connection terminal 9 through the tension spring 7, the circuit of the connection terminal 9 is switched between respective connection terminals 8 in response to operation of the conductor plate 6.

However, the foregoing conventional switch has the following problems:

(1) The number of parts composing the self-cleaning mechanism is many and its manufacturing cost is high.

(2) Because of its complicated structure, its assembling work is troublesome and the number of production steps goes up.

SUMMARY OF THE INVENTION

The present invention has been devised in view of the foregoing problems in the prior art, and its object is to provide a switch equipped with a self-cleaning mechanism which is simple in structure, reduced in number of parts, and easy in manufacturing and assembling.

The present invention resides in a switch of the structure in that inside a switch case fixed contacts are provided, in the switch case a slider movable in directions toward and away from the fixed contacts and an operation member for operating the slider are provided, and on the slider a moving contact is provided contactable with the fixed contacts, and is characterized in that the moving contact has flanges, the slider is formed with rest portions upon which the flanges abut under the state where the moving contact is in the inclined pose with respect to the slider-moving direction, and a spring is provided which pushes the moving contact toward the fixed contact and pushes the flanges against the rest portions.

DETAILED DESCRIPTION OF THE INVENTION

Figure 1:
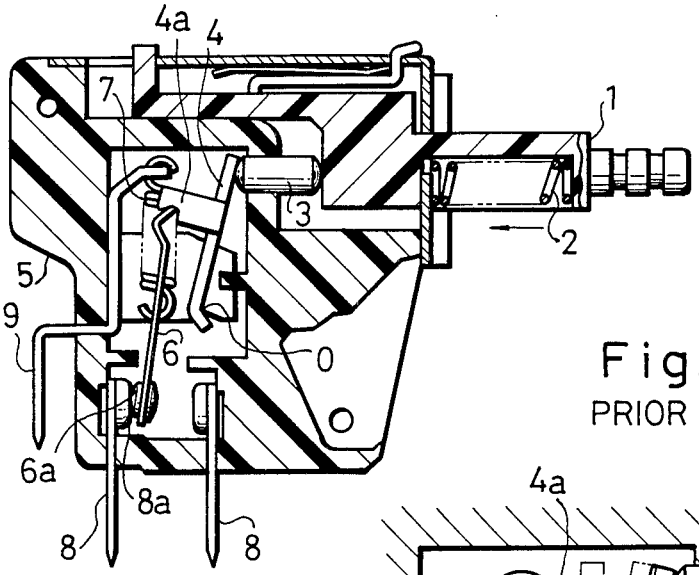
Fig.1 PRIOR ART
FIG. 1 is a longitudinal sectional view of the conventional switch.
Figure 2:
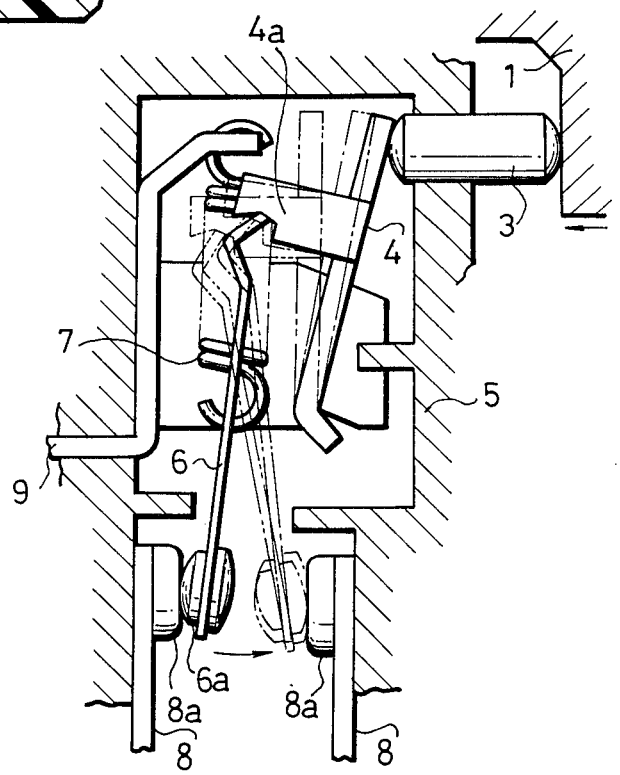
Fig.2 PRIOR ART
FIG. 2 is a partial enlarged view of FIG. 1.
Figure 3:
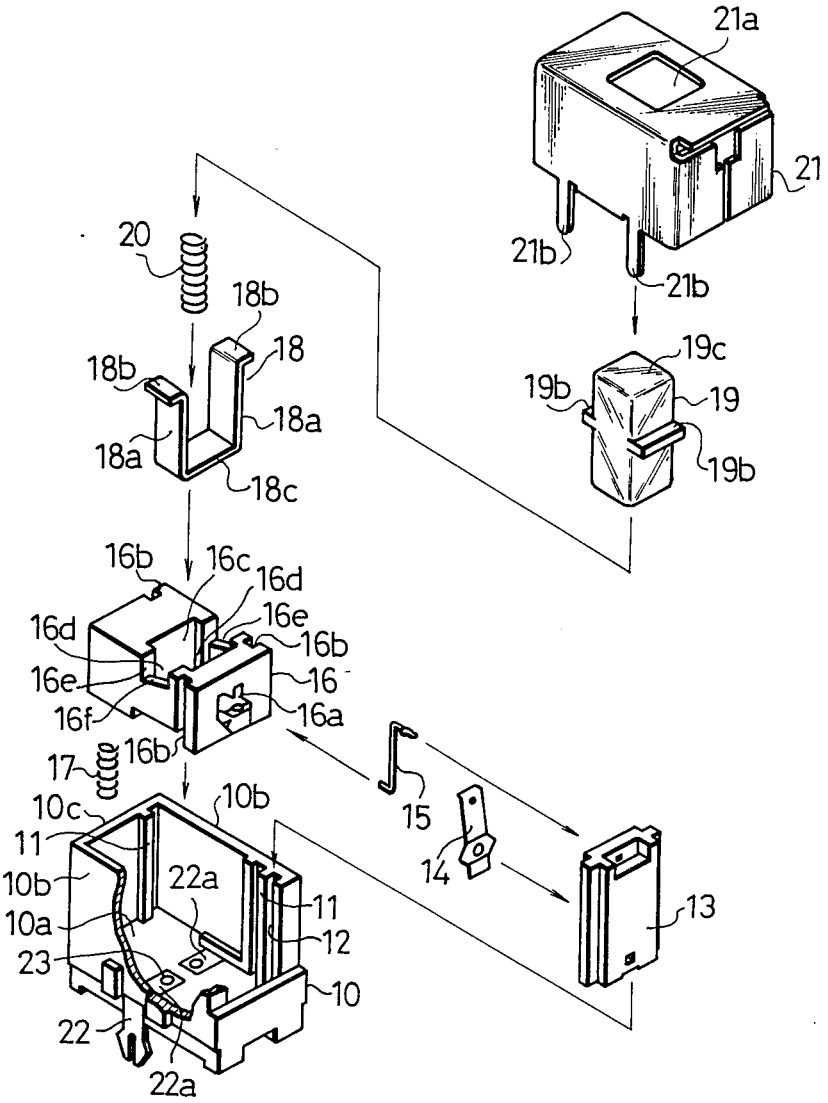
FIG. 3 is an exploded perspective view of an embodiment according to the present invention.

The embodiments of the present invention will be described with reference to FIG. 3 and so forth wherein the embodical switch is of the on/off type.

In the drawings, 10 is a wafer. This wafer 10 is made in an integral form and composed of a bottom 10*a* and three walls 10*b*, 10*c* surrounding the bottom 10*a*. On the bottom 10*a* a pair of flat portions 22*a* are exposed which are portions of paired external connection terminals 22 bent in an L shape, and on the flat portions 22*a* fixed contacts 23 are provided. On the paired mutually opposing walls 10*b* elongated projections 11 are formed individually, extending upward from the bottom 10*a*. On the other wall 10*c* coupling the above walls 10*b* together a similar elongated projection 11 is also formed. At end portions of the wall 10*b* in the vicinity of the opening (remote from the wall 10*c*) mutually opposing grooves 12 are formed in parallel with the above elongated projections 11. In these grooves 12 a support board 13 is fitted. By this support board 13 one end of a lock pin 15 is pivotably supported via a flat spring 14. This lock pin 15 has the form of a crank, with its other end inserted in a heart-shaped cam 16*a* formed in the side face of a slider 16. As is well known for conventional devices, for example, as shown in U.S. Pat. No. 3,914,570 to Lockard, the lockpin 15 is biased by spring 14 into a latching groove in heart-shaped cam 16*a* in order to latch or unlatch the slider 16 when it is moved between an initial position and a depressed position at which a contact is closed (to be described further herein).

This slider 16 is shaped in a cuboid. In three side faces of the slider 16 grooves 16*b* are formed which are engaged with the elongated projections 11 formed inside the wafer 10, and on the other side face the foregoing heart-shaped cam 16*a* is formed. Further, in the slider 16 a square hole 16*c* is bored passing through vertically in the drawing. In mutually opposing inner faces of this square hole 16*c* slide grooves 16*d* are formed. These slide grooves 16*d* are formed with notches 16*e*. These notches 16*e* are passing through from side to side. At the bottom of each notch 16*e* a rest portion 16*f* inclined a certain angle is formed. 17 is a compression spring which is interposed between the bottom of the slider 16 and the bottom 10*a* of the wafer 10.

Figure 4:
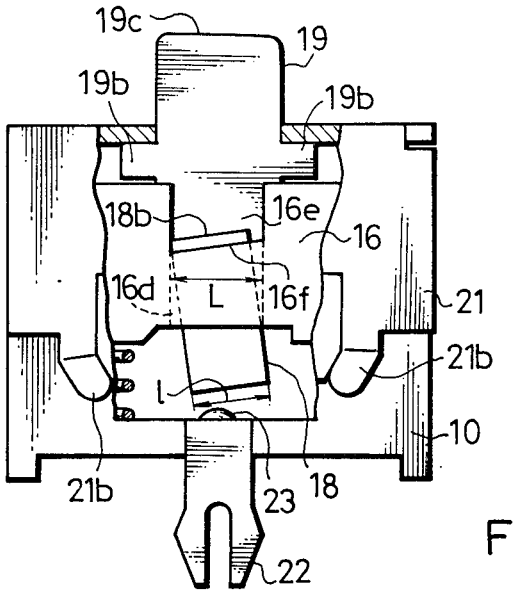
FIG. 4 is a front view illustrating the assembled state of the present switch.

18 is a moving contact. This moving contact 18 is bent in a U shape to give upright portions 18*a* with flanges 18*b* formed at the upper ends thereof. As shown in FIG. 4, the upright portions 18*a* of the moving contact 18 are inserted in the slide grooves 16*d* of the slider 16, provided that the width l of the slider is designed narrower than the width L of the slide groove 16*d*. When the flanges 18*b* of the moving contact 18 are placed on the rest portions 16*f* of the notches 16*e* formed in the slider 16, as shown in the drawing, this moving contact 18 inclines and is supported at two diagonal points on the side face of each slide groove 16*d*.

Figure 5:
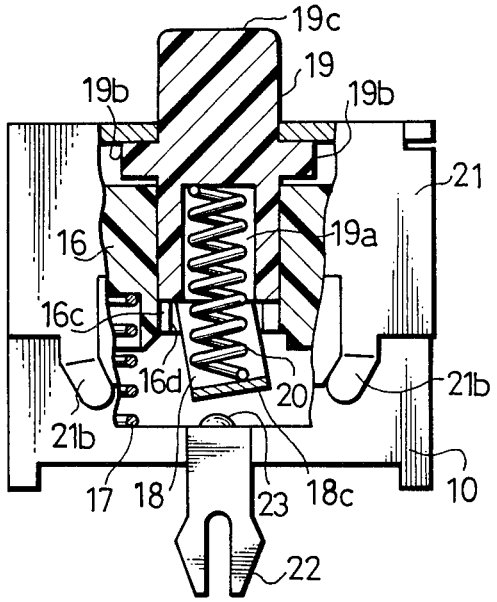
FIG. 5 is a partial sectional view of FIG. 4.

Further, in the square hole 16*c* of the slider 16 an operation member 19 is inserted. As shown in FIG. 5, in the bottom of this operation member 19 a hole 19*a* of a certain depth is bored. In this hole 19*a* a compression spring 20 is stored, and the lower end of this compression spring 20 abuts upon and pushes the bottom portion 18*c* of the moving contact 18. The operation member 19 has flanges 19*b* at its midway portions which are to abut upon the upper face of the slider 16.

Furthermore, 21 is a switch cover. This switch cover 21 is attached to the wafer 10 from the above as viewed in the drawing. Thus, a pushing face 19*c* of the operation member 19 projects through a hole 21*a* bored in the switch cover. At the lower end of the switch cover 21 pawls 21*b* are formed which are locked on the wafer 10 so as not to get loose.

Now, the operation of the present switch having the foregoing structure and assembled in due steps will be described. FIGS. 4 and 5 illustrate the switch-off state.

Figure 6:
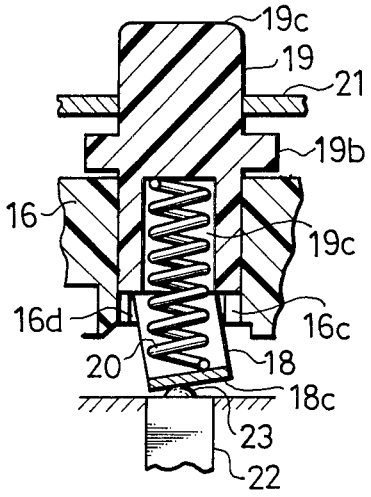
FIG. 6 is a partial sectional view of the operating state of the switch.
Figure 7:
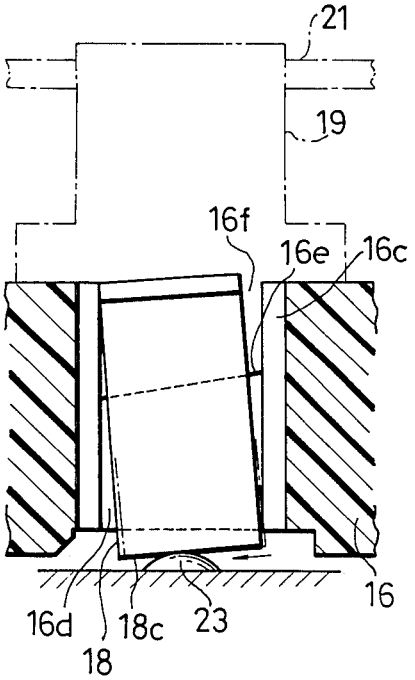
FIG. 7 is an enlarged sectional view illustrating the characteristic portion of the switch.

In the switch-off state, the compression spring 20 is pushing the moving contact 18. Accordingly, the flanges 18*b* of the moving contact 18 are in press contact with the rest portions 16*f* of the slider 16, as the result, the moving contact 18 is in the inclined state inside the slider 16. In case of changing the switch to ON, a pressure is applied first to the pushing face 19*c* of the operation member 19. In response thereto, the operations member 19 pushes the moving contact 18 via the compression spring 20, at the same time, the flanges 18*b* of the moving contact 18 push the slider 16 via the rest portions 16*f*. Consequently, the slider 16 moves down while being supported by the elongated projections 11 formed on the wafer 10 and resisting to the spring force of the compression spring 17. Then, at first, the bottom portion 18*c* of the moving contact 18 abuts upon the fixed contacts 23 attached to the flat portions 22*a* of the external connection terminals 22 and stops there. In this state, the external connection terminals 22 are conducted through the moving contact 18, resulting in the switch-on state (the position shown in FIG. 6). Then, as the operation member 19 is depressed further thereby to move the slider 16 downward, the moving contact 18, which is supported at the two diagonal points in the inclined pose inside the slide grooves 16*d* of the slider 1, moves relatively with respect to the slide grooves 16*d* and is corrected its inclined pose. That is, without changing the condition that it is pushed to and contacting with the fixed contacts 23, the moving contact 18 changes from the inclined pose indicated by the alternate long and short dash lines in FIG. 7 to the pose indicated by the full lines. As a result, the fixed contacts 23 and the moving contact 18 slide mutually, whereby dust and the like adhered on the fixed contacts 23 are swept off.

Thereafter, upon the operation member 19 reaches the bottom dead point, the heart-shaped cam 16 formed in the side face of the slider 16 comes into engagement with the lock pin 15 and the slider 16 stops. On the other hand, the operation member 19 moves up owing to the spring force of the compression spring 20 and returns to the initial position. Of course, during the above, the moving contact 18 is abutting upon the fixed contacts 23 because it is pushed by the compression spring 20.

Reversely, in the case of switching to OFF, by pushing again the operation member 19 the flanges 19*b* of the operation member 19 push slightly the slider 16, the engagement of the lock pin 15 with the heart-shaped cam 16*a* is released, and the slider 16 moves up owing to the spring force of the compression spring 17. During the above, the moving contact 18 slides relatively downward owing to be compression spring 20 and restores its inclined pose inside the slide grooves 16*d* of the slider 16. Then, the flanges 18*b* are received by the rest portions 16*f* of the slider 16, the moving contact 18 moves up, the switch changes to OFF, and the initial position is recovered.

Figure 8:
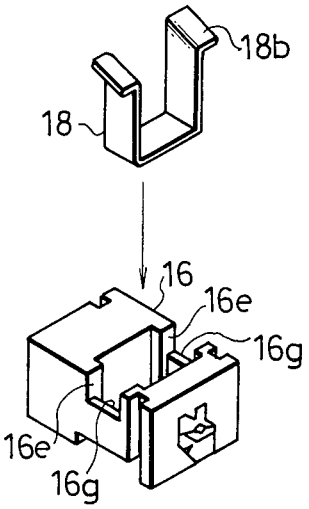
FIG. 8 is a perspective view illustrating the important portion of another embodiment according to the present invention.

FIG. 8 illustrates in the perspective view the important portion of another embodical switch.

In this second embodiment, the rest portion 16*g* at the notch 16*e* of the slider 16 is shaped at a right angle relative to the moving direction of the slider 16, whereas the flange 18*b* of the moving contact 18 is bent with an inclination. Similarly to the first embodiment, the moving contact 18 of this second embodiment is coupled on the slider 16 in the inclined pose. Accordingly, this embodiment produces the same effects as that of the first embodiment.

As apparent from the foregoing description, the present invention features the following effects:

(1) According to the present invention, the moving contact is provided with the flanges, whereas the slider is formed with the rest portions upon which the flanges abut under the state where the moving contact is in the inclined pose with respect to the slider-moving direction. The switch is equipped with the spring to push the moving contact toward the fixed contacts and to push the flanges against the rest portions. In response to correction of the inclined pose of the moving contact these contacts slide mutually, whereby self-cleaning takes place. Therefore, complicated mechanisms for self-cleaning are not required, assembling is simplified, the working efficiency is better, and mass-productivity is excellent.

(2) The number of parts is relatively few, and reduction of the manufacturing cost can be promoted.

(3) Further, because the moving contact slides on the fixed contacts while it is press contacted with the fixed contacts by the spring in response to downward movement of the operation member, press contacting between the contacts is assured and the reliability of operation is high.

While the preferred embodiments have been described, variations thereto will occur to those skilled in the art within the scope of the present inventive concepts which are delineated by the following claims.

What is claimed is:

1. A switch comprising a casing, a fixed contact in said casing, a moving contact movable into and out of contact with said fixed contact, a slider supporting said moving contact, and an operation member for operating said slider for moving said moving contact toward and away from said fixed contact, wherein said moving contact has a first portion extending toward said fixed contact and a flange portion transverse to said first portion, said slider has a guide portion for supporting said first portion of said moving contact, said guide portion having a transverse width larger than a width of said first portion such that said first portion can assume an inclined pose in said guide portion relative to a direction of movement of said slider, and said slider further has a rest portion on which said flange portion of said moving contact can abut, one of said rest portion and said flange portion being inclined relative to the other such that when said flange portion abuts said rest portion, said moving contact is positioned in said inclined pose, and said switch further comprising a spring for biasing said flange portion to abut said rest portion such that said moving contact can contact said fixed contact in said inclined pose.

2. A switch as set forth in claim 1, wherein the inclined pose of said moving contact is achieved by said rest portions being inclined a little with respect to the level orthogonal to the slider-moving direction.

3. A switch as set forth in claim 1, wherein the inclined pose of said moving contact is achieved by said flanges being inclined a little with respect to the level orthogonal to the slider-moving direction.

4. A switch as set forth in claim 1, further comprising a compression spring interposed between a portion of said casing and said slider, and latching means in the form of a lock pin mounted in said casing and a heart-shaped cam mounted on said slider for latching and unlatching said slider in its movement against the biasing force of said compression spring toward and away from said fixed contact, such that said switch is provided with a two-positioned push type operation.

* * * * *